United States Patent [19]

Griffin et al.

[11] 4,103,277

[45] Jul. 25, 1978

[54] CERAMIC ENVELOPED ELECTRICAL HEATING ELEMENT

[75] Inventors: Robert M. Griffin, South Hamilton; Max E. Oberlin, Lynn; Robert P. Bonazoli, Hamilton, all of Mass.

[73] Assignee: GTE Sylvania Incorporated, Danvers, Mass.

[21] Appl. No.: 751,660

[22] Filed: Dec. 17, 1976

[51] Int. Cl.[2] ..... H01C 1/024

[52] U.S. Cl. ..... 338/237; 13/25; 219/354; 219/553; 338/234; 338/318

[58] Field of Search ..... 338/234–237, 338/272, 273, 274, 276, 318; 219/552, 553, 354; 313/317, 320, 274, 322, 275, 182, 271, 315; 13/25

[56] References Cited

U.S. PATENT DOCUMENTS

| | | | |
|---|---|---|---|
| 1,947,793 | 2/1934 | O'Neil et al. | 338/235 |
| 2,215,587 | 9/1940 | Kerschbaum | 338/237 |
| 2,864,025 | 12/1958 | Foote et al. | 219/354 |
| 3,428,846 | 2/1969 | Rigden et al. | 174/50.63 X |
| 3,448,319 | 6/1969 | Louden | 174/50.61 X |
| 3,538,374 | 11/1970 | Kane | 219/553 X |
| 3,571,477 | 3/1971 | Phillips | 13/25 |

FOREIGN PATENT DOCUMENTS

| | | | |
|---|---|---|---|
| 595,060 | 11/1947 | United Kingdom | 338/237 |

*Primary Examiner*—C. L. Albritton
*Attorney, Agent, or Firm*—James H. Grover

[57] ABSTRACT

An electrical heating element for ovens, furnaces and other infrared light applications comprises an elongate tubular envelope of thermally translucent refractory material such as pure alumina enclosing an elongate coiled refractory metal conductor which is capable of carrying a linear power loading of at least one hundred watts per inch. Refractory spacers along the coiled conductor and envelope hold the conductor spaced from the envelope and coaxial therewith so that the conductor attains heat in excess of the temperature limit of the envelope.

2 Claims, 3 Drawing Figures

CERAMIC ENVELOPED ELECTRICAL HEATING ELEMENT

RELATED APPLICATION

Reference is made to the application of Robert M. Griffin, Max E. Oberlin and Emery G. Audesse, entitled Hermetically Sealed Electrical Gas Fuel Igniter, filed concurrently herewith and incorporated by reference herein.

BACKGROUND OF THE INVENTION

The present invention concerns heating elements for operation at temperatures in the order of 1000° and higher up to 1900° C. Previously known elements of this nature include enveloped infrared lamps, and air exposed filamentary heating elements of refractory compounds and alloys. Available elements include those of chrome-iron alloy, silicon carbide and molybdenum disilicide. Infrared lamps with quartz bulbs have advantages up to 1000° C bulb temperature but are subject to devitrification if handled improperly. The chrome-iron alloy filaments are limited to 1200° C, require bulky ceramic supports and periodic pre-oxidation for corrosion resistance. They have low power loading (e.g. 30 to 40 watts per inch squared, low electrical efficiency and are subject to attack by materials being treated in the oven or furnace such as salts, glazes, enamels, hydrocarbon and nitrogen. The silicon carbide and molybdenum disilicide filaments attain temperatures of 1500° to 1800° C but are very fragile and expensive, have low electrical efficiency at high cost. Silicon carbide can carry only a low power loading of thirty five watts per inch squared.

There remains a need for a heating element which is chemically inert and impervious to oxidation, has a high operating temperature (up to 1900° C), and a high power loading (e.g. 1000 watts per square inch; 100 watts per linear inch). Further the element should be inexpensive itself and should not require expensive supports or fixtures, and should be of rugged construction and easy to install and replace.

STATEMENT OF INVENTION

According to the invention an electrical resistance heating element comprises a sealed elongate envelope of thermal radiation translucent material, an elongate coiled refractory metal conductor dimensioned to carry a linear power loading rating of at least one hundred watts per inch, refractory means engaging the conductor and envelope at spaced locations along their lengths for holding the conductor spaced from the envelope substantially coaxially therewith, and conductive means for supplying electrical current to the conductor at said power loading so as to ohmically heat the conductor and transmit heat externally of the envelope.

DRAWINGS

DESCRIPTION

Figure 1:
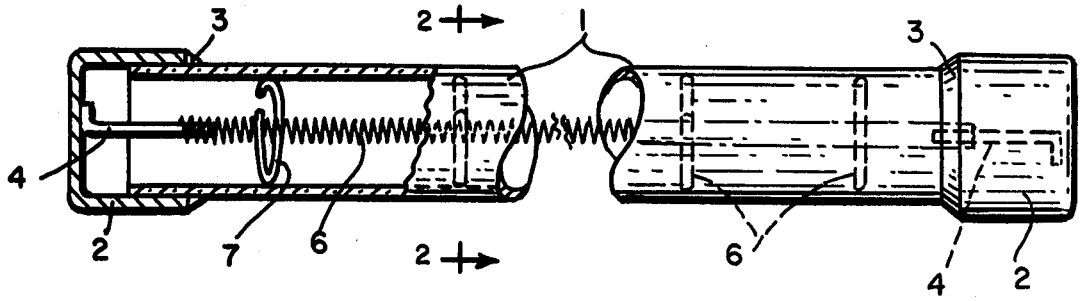
FIG. 1 is a side elevation, partly in section, of a heating element according to the invention.
Figure 2:
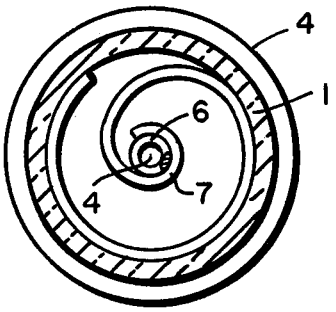
FIG. 2 is a section on line 2—2 of FIG. 1.

The electrical heating unit of FIGS. 1 and 2 comprises a tubular aluminum circuit envelope 1 typically 12 inches long and 0.35 inches in diameter, with a wall thickness of 0.030 inches. The ceramic is preferably very pure (99%) to extremely pure (99.99%) alumina. The tube is sealed at both ends with end caps 2 of Kovar (Westinghouse Corporation), for example, hermetically sealed to the tube 1 by a bonding material having adhesive and thermal compatibility with the ceramic, for example, Corning Glassworks borosilicate sealing glass No. 7052. Refractory metal lead wires or spuds 4 of Kovar, tungsten or molybdenum are welded to the end caps 2 and extend into the turns of a coiled heating conductor 6.

The conductor 6 is preferably tungsten wire of 0.011 inches diameter, but may be tantalum or molybdenum. For a 0.350 inches OD by 12 inch length tube the conductor is closely wound in a coil of 0.073 inches OD approximately 10 inches long, that is about two inches shorter than the envelope.

The coiled conductor is designed for horizontal installation and is supported somewhat less than every inch by spiral spacers 7, eleven spacers in the case of a 10 inch coil. The spacers are refractory metal, preferably tantalum, and hold the coiled conductor substantially coaxial with the envelope.

The preferred method of sealing the envelope involves exhausting the envelope in a vacuum furnace, and making the seal in an atmosphere of an antioxidant gas such as hydrogen or the inert gases, e.g. nitrogen or argon, leaving the anti-oxidant gas as a fill in the envelope.

Figure 3:
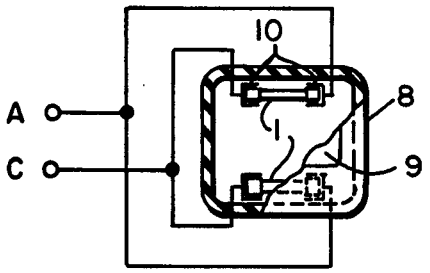
FIG. 3 is a schematic showing of the heating element in a furnace.

A twelve inch heating element made according to the foregoing specifications will at 120 volts AC draw 550 watts when installed in an oven with an air ambient such as is shown in FIG. 3. Therein the oven comprises refractory walls 8 and a door or other access 9. Two heating elements are installed adjacent the wall simply by inserting them in simple fuse clip type of sockets 10 connected directly to AC terminals. In such an installation the heating element has stabilized at a coil temperature of 1747° C, outer envelope wall temperature of 1390° C maximum heating the air ambient to 1237° C. With a coil temperature of 2200° C ambient temperatures of about 2000° C are available.

Such a heating element not only has the advantages of rugged design and ease of installation and removal, but requires minimal maintenance and is chemically inert. The element can operate directly off the line with a high power loading providing fast warming to temperatures at which quartz enveloped lamps melt. And yet, unlike air-exposed filament heaters, the present heater can operate at any temperature between room temperature and its maximum of about 1850° C.

It should be understood that the present disclosure is for the purpose of illustration only and that this invention includes all modifications and equivalents which fall within the scope of the appended claims.

We claim:

1. An electrical resistance heating element comprising:

an elongate hollow translucent envelope of 99% pure alumina ceramic, end caps bonded at opposite ends of the envelope to hermetically seal the envelope from the atmosphere, an elongate coiled refractory metal conductor dimensioned to carry a linear power loading rating of at least one hundred watts per inch, refractory means engaging the conductor and envelope at spaced locations along their lengths for holding the conductor spaced from the envelope substantially coaxially therewith, and conductive means for supplying electrical current to the conductor at said power loading so as to ohmically heat the conductor and transmit heat externally of the envelope.

2. A heating element according to claim 1 wherein the conductor has a melting point in excess of 1900° C.

* * * * *